US006937201B2

(12) United States Patent
Gothard et al.

(10) Patent No.: US 6,937,201 B2
(45) Date of Patent: Aug. 30, 2005

(54) MULTI-BAND COAXIAL RING-FOCUS ANTENNA WITH CO-LOCATED SUBREFLECTORS

(75) Inventors: Griffin K. Gothard, Satellite Beach, FL (US); Jay A. Kralovec, Melbourne, FL (US); Sean C. Ortiz, West Melbourne, FL (US); Timothy E. Durham, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 74 days.

(21) Appl. No.: 10/703,257

(22) Filed: Nov. 7, 2003

(65) Prior Publication Data

US 2005/0099351 A1 May 12, 2005

(51) Int. Cl.[7] ..... H01Q 13/00
(52) U.S. Cl. ..... 343/781 P; 343/781 CA
(58) Field of Search ..... 343/781, 773, 343/786

(56) References Cited

U.S. PATENT DOCUMENTS 4,283,728 A * 8/1981 Bartlett ..... 343/781 CA
4,489,331 A * 12/1984 Salvat et al. ..... 343/753
5,373,302 A * 12/1994 Wu ..... 343/781 P
5,907,309 A 5/1999 Anderson et al.
6,211,834 B1 * 4/2001 Durham et al. ..... 343/781 P
6,323,819 B1 11/2001 Ergene
6,545,645 B1 4/2003 Wu
6,680,711 B2 * 1/2004 Desargant et al. .... 343/781 CA
6,697,028 B1 * 2/2004 Gothard et al. ..... 373/781 CA
6,831,613 B1 * 12/2004 Gothard et al. ..... 343/779

FOREIGN PATENT DOCUMENTS

CA 1 191 944 8/1985

OTHER PUBLICATIONS

U.S. Appl. No. 10/231,933, filed Aug. 29, 2002, Gothard et al.
U.S. Appl. No. 10/600,627, filed Jun. 20, 2003, Gothard et al.

* cited by examiner

*Primary Examiner*—Hoang V. Nguyen
*Assistant Examiner*—Hung Tran Vy
(74) *Attorney, Agent, or Firm*—Sacco & Associates, PA

(57) ABSTRACT

A multi-band ring focus antenna system includes a main reflector (408) that is operable at a plurality spectrally offset frequency bands. A first feed (301, 403) includes a first feed horn (301) and a first sub-reflector (403), which are positioned spaced apart from each other at respective locations along a boresight axis of the main reflector. The locations are selected so that the first feed horn and the first sub-reflector share a commonly located first phase center (401). A second feed (302, 404) designed for operation on a second RF frequency band includes a second feed horn (302) and a second sub-reflector (404), each positioned at a location along the boresight axis of the main reflector so that they share a commonly located second phase center.

20 Claims, 5 Drawing Sheets

MULTI-BAND COAXIAL RING-FOCUS ANTENNA WITH CO-LOCATED SUBREFLECTORS

BACKGROUND OF THE INVENTION

1. Statement of the Technical Field

The inventive arrangements relate generally to methods and apparatus for antennas and feed systems, and more particularly to ring focus antennas and feed systems that can operate in multiple frequency bands.

2. Description of the Related Art

It is often desirable for microwave satellite communication antennas to have the ability to concurrently operate on multiple frequency bands. In those situations where a single coaxial feed for multiple bands is desired, it can be challenging to maintain existing system performance specifications without changing the design of an existing main reflector. Further, space limitations associated with existing designs can severely restrict design options with regard to the form factor of the sub-reflector and feed horns.

U.S. Pat. No. 6,211,834 B1 to Durham et al. (hereinafter Durham), concerns a multi-band shaped ring focus antenna. In Durham, a pair of interchangeable, diversely shaped, close proximity-coupled sub-reflector-feed pairs are used for operation at respectively different spectral frequency bands. Swapping out the subreflector/feed pairs changes the operational band of the antenna. Accordingly, that system does not offer concurrent operation on spectrally offset frequency bands.

U.S. Pat. No. 5,907,309 to Anderson et al. and U.S. Pat. No. 6,323,819 to Ergene each disclose dual band multimode coaxial antenna feed horns. However, one problem with coaxial horns of this type is that there is a substantial tendency of horns for different bands to interact with one another due to their coaxial arrangement. These interactions can be exacerbated by co-locating the horn apertures at a substantially common plane. Still, substantially co-located horn apertures have proven to be necessary in many instances due to the need to maintain a common phase center.

The necessity to maintain a common phase center for each horn typically arises where the horns are used to feed a conventional reflector type antenna system. For example, the combination of a particular main reflector and sub-reflector pair for a ring focus antenna will generally establish a required phase center for the feed horns. Where a coaxial horn feed system is used, each horn in the coaxial feed must satisfy the common phase center location requirements.

SUMMARY OF THE INVENTION

The invention concerns a multi-band ring focus antenna system. The system includes a main reflector that is operable at a plurality spectrally offset frequency bands. A first feed for the main reflector is provided for operation of the main reflector on a first RF frequency band. The first feed includes a first feed horn and a first sub-reflector, which are positioned spaced apart from each other at respective locations along a boresight axis of the main reflector. The locations are selected so that the first feed horn and the first sub-reflector share a commonly located first phase center.

A second feed is also provided for the main reflector. The second feed is designed for operation on a second RF frequency band spectrally offset from the first band. The second feed includes a second feed horn and a second sub-reflector, each positioned at a location along the boresight axis of the main reflector so that they share a commonly located second phase center. Further, the first and second vertexes of the respective first and second sub-reflectors are substantially co-located at an equal distance from the main reflector.

According to one aspect, the first and second sub-reflectors each form a focal ring respectively for each of the first and second bands. The focal rings are formed at a predetermined common location spaced from the main reflector for concurrently illuminating the main reflector on the first and second bands. In order to achieve this result, at least one of the first and second sub-reflectors can be a frequency selective surface.

At least a portion of the second feed horn can be coaxially positioned within the first feed horn. Further, the first and second sub-reflectors can each define a shaped surface of revolution about the boresight axis of the main reflector. The shaped surface of revolution can be selected so as to have no continuous surface portion thereof shaped as a regular conical surface of revolution. Similarly, the main reflector can define a shaped surface of revolution about the boresight axis having no continuous surface portion thereof shaped as a regular conical surface of revolution.

According to one aspect of the invention, at least a portion of the shaped surface of revolution that comprises the second sub-reflector can be interposed between the first horn and the first sub-reflector. In that case, the second sub-reflector is advantageously formed as a frequency selective surface.

According to another aspect of the invention the first feed horn can be a corrugated horn and the second feed horn can be a smooth walled or modal horn.

Further, each of the first and second feed horns can be decoupled from the first and second sub-reflectors.

The invention can also concern a method for multi-band operation of a ring focus antenna. The method can include the steps of feeding a main reflector of the ring focus antenna on a first RF frequency band using a first feed horn spaced apart from a first sub-reflector, where each is positioned along a boresight axis of the main reflector; and feeding the main reflector on a second RF frequency band spectrally offset from the first band using a second feed horn spaced apart from a second sub-reflector, where each is positioned along the boresight axis. The method can further include the steps of co-locating a vertex of the first and second sub-reflector at a substantially equal distance from the main reflector to form with the first and second sub-reflectors a focal ring for each of the first and second bands at a common predetermined location spaced from the main reflector for concurrently illuminating the main reflector on the first and second bands. Finally, the method can also include the step of positioning the first and second feed horns so that the phase center of each feed horn is located at a respectively different distance from the co-located vertexes.

In order to achieve the foregoing, the first sub-reflector can be shaped to have a phase center corresponding to a position of the phase center of the first horn. Likewise, the second sub-reflector can be shaped to have a phase center corresponding to a position of the phase center of the second horn. The method can include the step of forming the first and second sub-reflectors so that each defines a shaped surface of revolution about the boresight axis of the main reflector having no continuous surface portion thereof shaped as a regular conical surface of revolution. Similarly, the method can include selecting the main reflector to define a shaped surface of revolution about the boresight axis having no continuous surface portion thereof shaped as a regular conical surface of revolution.

According to another aspect, the method can include the step of forming the second sub-reflector as a frequency selective surface. In that case, at least a portion of the second sub-reflector can be interposed between the first sub-reflector and the first feed horn. Finally, the method can also include the step of positioning each of the first feed horn and the second feed horn respectively at a distance from the first and second sub-reflectors so that they are decoupled.

DETAILED DESCRIPTION OF THE PREFERRED EMBODIMENTS

Shaped ring focus antennas typically have an approximately split parabolic main reflector and an approximately ellipsoidal subreflector. Advantageously, the conical properties of the ellipsoid-shaped subreflector provide a dual focus characteristic, with one of its foci displaced toward the vicinity of the aperture of the main reflector where a feed horn is installed. The other focus is symmetric about the antenna axis in the form of a ring, which enables the antenna to obtain a substantially uniform amplitude distribution in the aperture plane. As a consequence of this geometry, the antenna is more compact than a conventional center-fed structure.

Figure 1:
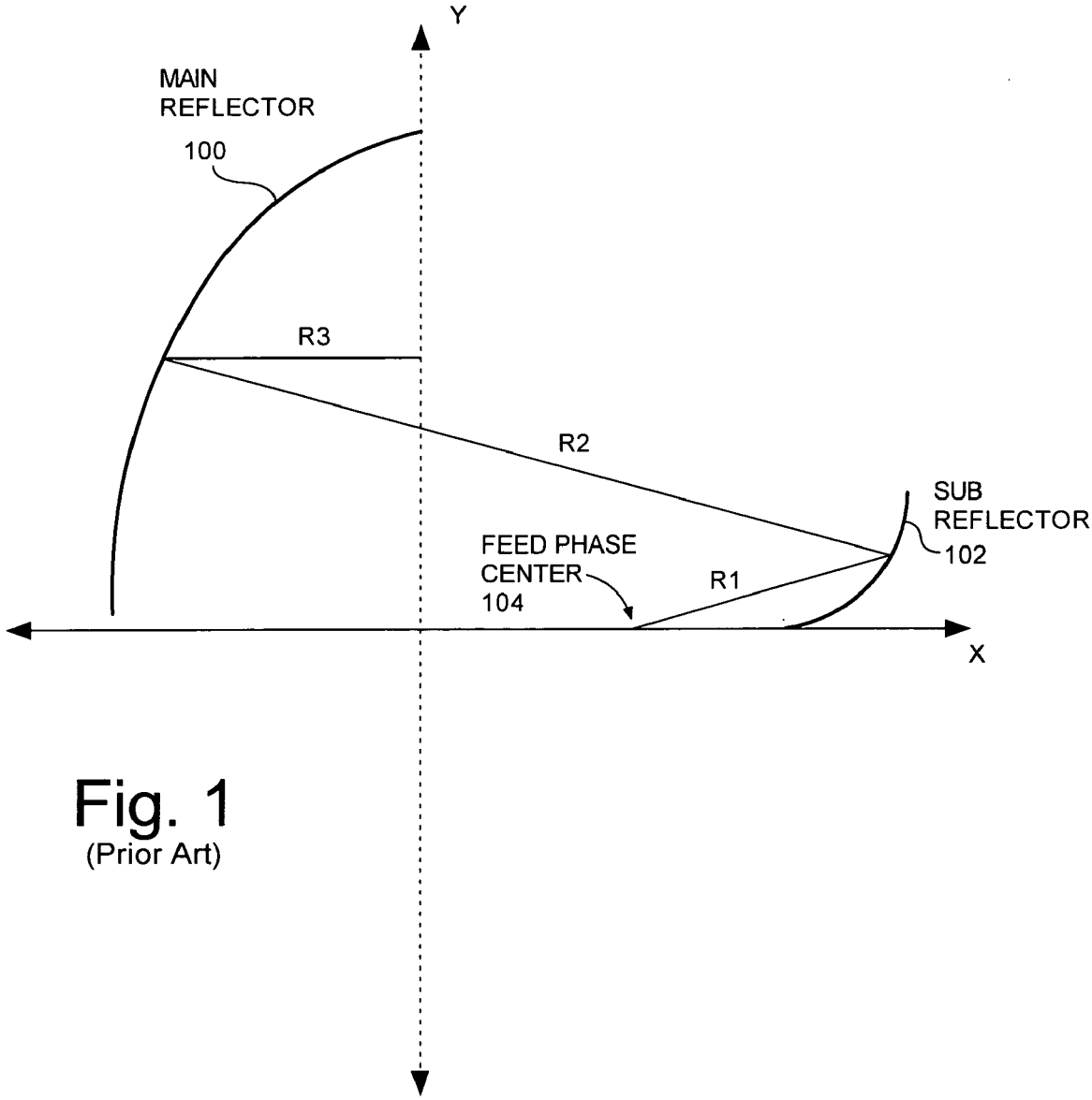
Fig. 1 (Prior Art)
FIG. 1 is a schematic representation showing the operation of a conventional shaped ring-focus antenna system.

A simple ray diagram for a conventional ring-focus reflector antenna system is illustrated in FIG. 1. Only half of the ray diagram is show, the other half below the x axis being the mirror image. The antenna system includes a main reflector 100 and a sub-reflector 102. The size and shape of the main reflector define a focal ring that is radially disposed about the x axis and spaced some distance from the main reflector 100. The boresight axis of the main reflector 100 is coincident with the x axis in FIG. 1.

For the transmit path, RF energy is transmitted from a feed phase center 104 toward the sub-reflector 102 and is reflected as shown. The transmitted RF energy is shown as ray R1. The reflected RF energy from the sub-reflector 102 forms a focal ring extending radially about the x axis. The focal ring coincides with the size and location focal ring of the main reflector for illuminating the main reflector 100. The reflected RF energy from the sub-reflector 102 is identified as ray R2 in FIG. 1. When the reflected RF energy strikes the main reflector 100, it is transmitted in a direction that is generally aligned with the boresight (x axis) of the main reflector 100. This reflected ray is identified as R3 in FIG. 1.

Received signals generally also traverse the path identified by rays R3, R2, and R1. Received signals strike the main reflector 100, are reflected and pass through the focal ring, are reflected by the sub-reflector 102, and finally arrive at the feed phase center 104. The feed for ring-focus reflector antennas is typically a microwave horn. The phase center of the feed horn is advantageously positioned so as to coincide with the phase center 104 of the sub-reflector. In general, radiated fields measured on the surface of a sphere whose center coincides with the phase center 104 have the same phase.

The exact location of the phase center relative to any feed horn will be determined by a variety of factors, including the dimensions of the horn and its flare angle. Generally, the phase center will be located somewhere between the throat of the horn and its aperture. For convenience, the phase center of the feed horns described herein shall be assumed to be at or near the aperture of the horn. However, the invention is not limited in this regard.

The sub-reflector 102 and main reflector 100 in the ring-focus antenna system of FIG. 1 are both shaped components. The term 'shaped' as used herein refers to a subreflector and main reflector geometry that is defined in accordance with a prescribed set of (reduced sidelobe envelope) directivity pattern relationships and boundary conditions for a prescribed set of equations, rather than a shape that is definable by an equation for a regular conic, such as a parabola or an ellipse. Boundary conditions can include main reflector and sub-reflector diameters and the feed phase center. Given prescribed feed inputs to and boundary conditions for the antenna, the shape of each of a subreflector and a main reflector are generated by executing a computer program that solves a prescribed set of equations for the predefined constraints. In a preferred embodiment, the equations are those which: 1—achieve conservation of energy across the antenna aperture, 2—provide equal phase across the antenna aperture, and 3—obey Snell's law. Details of the foregoing process are discussed in U.S. Pat. No. 6,211,834 to Durham et al, the disclosure of which is incorporated herein by reference.

While the boundary conditions may be selected to define a regular conical shape, such is not the intent of the shaping of the invention. The ultimate shape of each subreflector and the main reflector are whatever the parameters of the operational specification of the antenna dictate, when applied to the directivity pattern relationships and boundary conditions.

Once the shapes of a subreflector and main reflector pair have been generated, the performance of the antenna is subjected to computer analysis, to determine whether the generated antenna shapes will produce a desired directivity characteristic. If the design performance criteria are not initially satisfied, one or more of the parameter constraints are adjusted, and performance of the antenna is analyzed for the new set of shapes. This process is typically repeated iteratively, until the shaped pair meets the antenna's intended operational performance specification.

Figure 2:
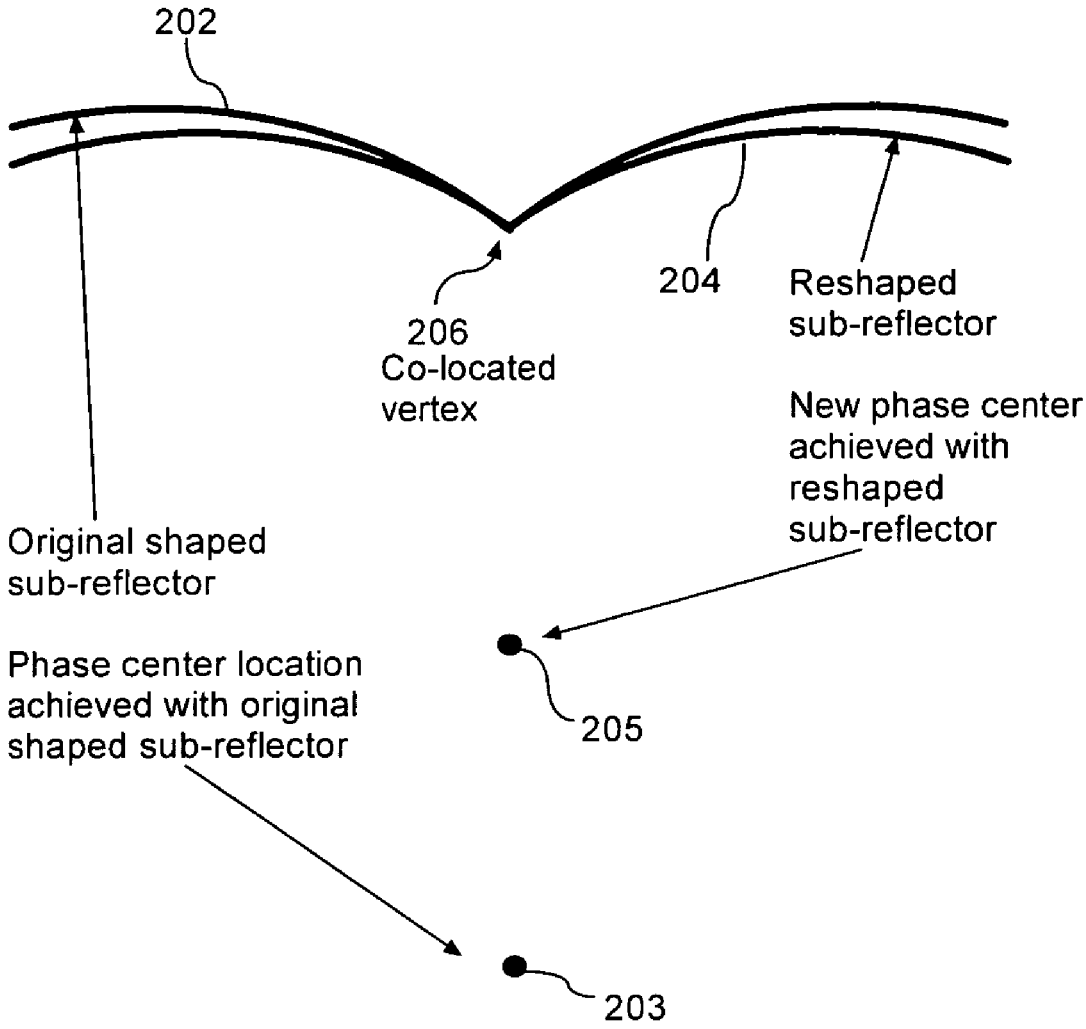
FIG. 2 is a drawing that is useful for understanding how the surface of a shaped sub-reflector can be controlled to vary an associated phase center.

Referring now to FIG. 2, it may be observed that the curved surface of a shaped sub-reflector 202 will also determine a feed phase center 203 for the sub-reflector. In the sub-reflector context, the feed phase center refers to the location a feed horn is positioned so that its aperture is coincident with the sub-reflector feed phase center. In general, changing a shape of a sub-reflector can vary the position of a feed phase center 203 relative to the sub-reflector vertex 206. According to a preferred embodiment of the invention, computer analysis can be used to vary the shape of the sub-reflector 202 in such as way that the focal ring remains substantially undisturbed. In other words, the location of the feed phase center for the sub-reflector can be varied independently of the focal ring. This concept is illustrated in FIG. 2 by the reshaped sub-reflector 204 that has the same focal ring as sub-reflector 202, but with the phase center 205 positioned closer to the vertex 206.

Once a sub-reflector/main reflector pair have been defined utilizing the computer analysis described above, the main reflector focal ring is fixed; i.e. unless the main reflector is modified, optimum antenna performance can only be achieved by utilizing a sub-reflector that has a focal ring that closely matches the main reflector focal ring.

The process to reshape the sub-reflector for a fixed main reflector can be summarized as follows:

Utilizing Snells law, characterize the focal ring of the main reflector (this focal ring cannot be modified)

Define a desired feed phase center location

Starting with the desired feed phase center location, use computer analysis to compute a sub-reflector shape that i. enforces constant path length from the desired feed phase center to the reflector aperture (In FIG. 1. R1+R2+R3=Constant for all paths)

ii. simultaneously enforce Snells law

Since it is possible to shift the sub-reflector vertex slightly with respect to the back of the main reflector (there is some degree of freedom if a slight antenna performance degradation is permitted), it can be advantageous to shape two new sub-reflectors (as opposed to utilizing the original+new) for some applications.

Figure 3:
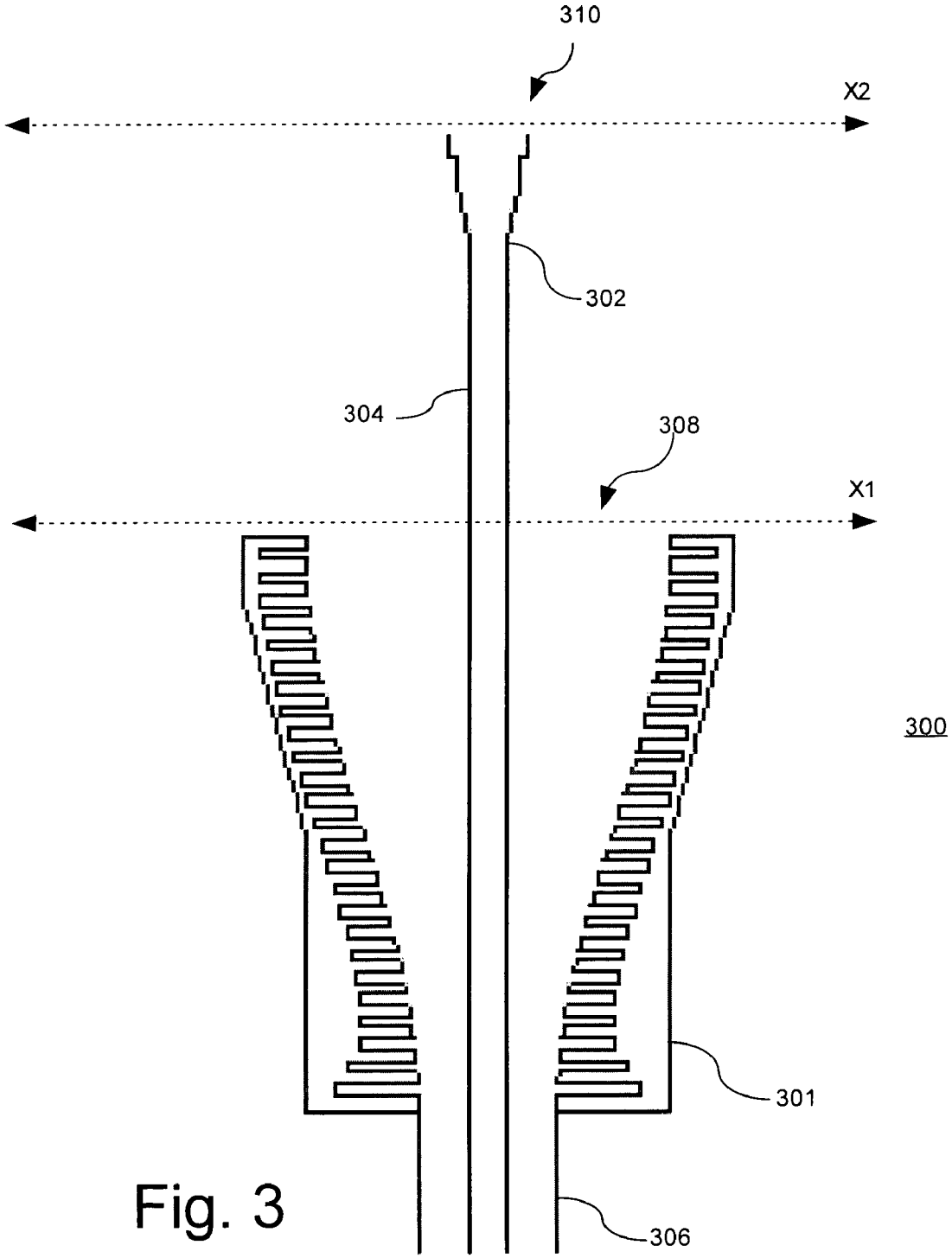
FIG. 3 is a cross-sectional view of a set of coaxial horn antennas that have substantially different phase centers.

The ability to independently vary the phase center of a sub-reflector has important implications in the reflector antenna field. For example, FIG. 3 illustrates a coaxial horn feed 300. The feed 300 includes a first horn antenna 301 and a second horn antenna 302 that is located coaxially within said first horn. The first feed horn is designed for operation on a first frequency band. The second feed horn is designed for operation on a second frequency band that is spectrally offset from the first band. A smooth walled portion 304 of the second horn 302 extends down a boresight axis of the first horn 301 and is aligned coaxially within a smooth walled section 306 of the first horn. In FIG. 3, horn 301 is a corrugated horn, but the invention is not limited in this regard.

In a coaxial horn arrangement, it can be advantageous for the aperture of the inner coaxial horn to be positioned substantially outside the aperture of the outer horn 301. This concept is illustrated in FIG. 3 where the aperture 310 of the second horn 302 extends substantially beyond the aperture 308 defined by the first horn 301. Displacing the apertures in this way can minimize the amount of interaction between the inner and outer horns. However, such displacement also tends to ensure that the respective phase centers of the inner and outer coaxial horns are substantially displaced relative to one another. This can be a serious problem if it is desired to use such an offset coaxial feed in a ring-focus reflector antenna because conventional sub-reflectors have only a single phase center.

Figure 4:
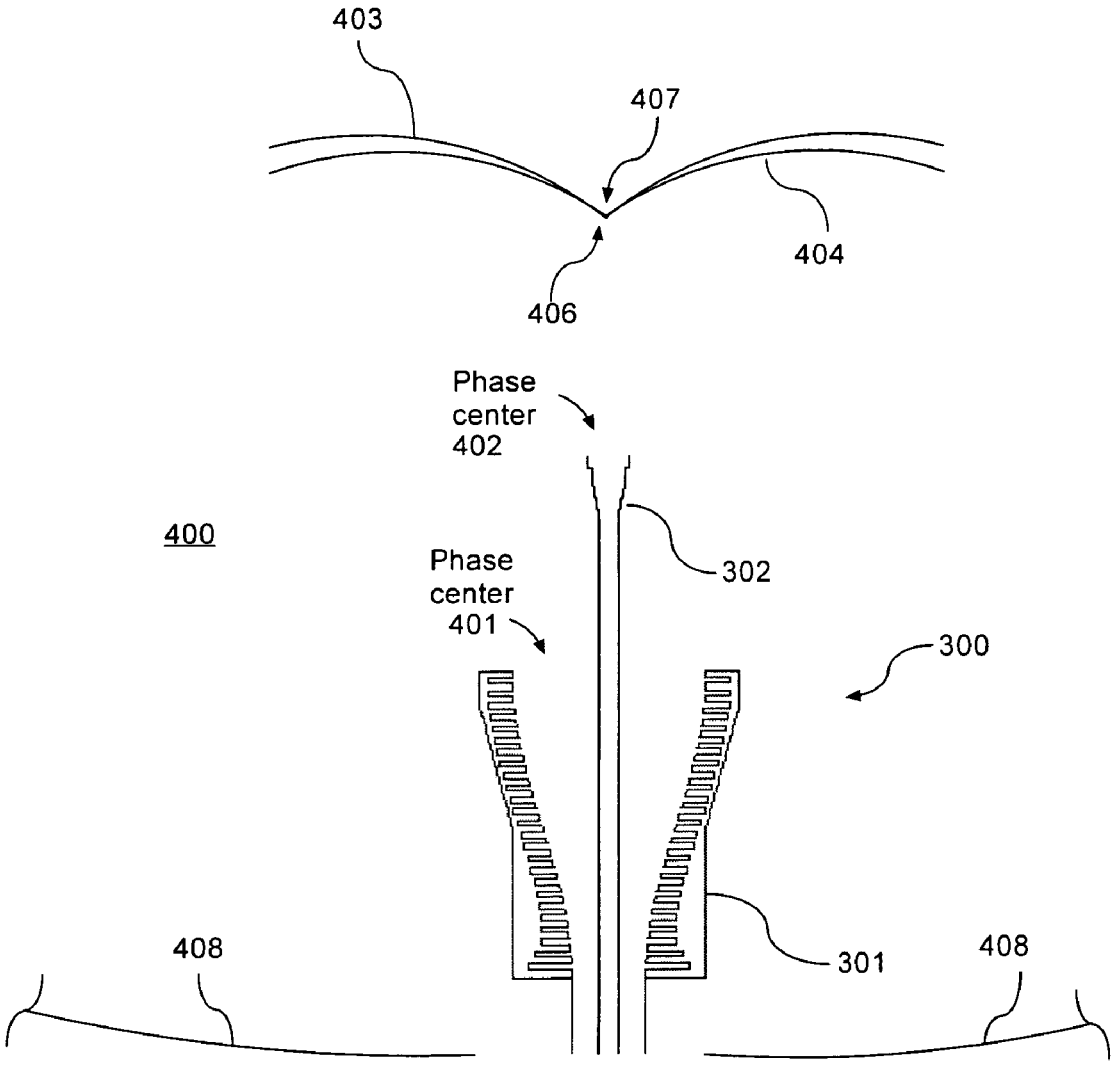
FIG. 4 shows the coaxial horn antennas of FIG. 3 spaced apart from the sub-reflectors of FIG. 2 along a boresight axis.

The foregoing problem can be overcome with the arrangement illustrated in FIG. 4. Structure in FIG. 4 that is common to FIG. 3 is identified using like reference numerals. In FIG. 4, a main reflector 408 for a ring-focus antenna system 400 can define a focal ring (not shown) extending radially about a boresight axis of the antenna in an area between the main reflector and a set of sub-reflectors 403, 404. According to a preferred embodiment, the main reflector 408 can be a shaped reflector designed to be operable at a plurality spectrally offset frequency bands. The coaxial horn feed 300 is used as a feed for the pair of shaped sub-reflectors 403, 404.

The focal rings produced by the sub-reflectors 403, 404 can be formed at a predetermined common location spaced from the main reflector for concurrently illuminating the main reflector on the first and second bands. Sub-reflectors 403, 404 can be shaped using the processed described herein to each define focal ring that is substantially co-located and spatially coincident with a focal ring of the main reflector 408. Further, the first and second vertexes 406, 407 of the respective first and second sub-reflectors can be substantially co-located at an equal distance from the main reflector. Shaping the sub-reflectors with a focal ring that satisfies the focal ring requirements of the main reflector and co-locating the vertex of each sub-reflector 406, 407 will allow each of the sub-reflectors 403, 404 to operate in conjunction with the main reflector 408.

Using techniques previously described in relation to FIG. 2, the phase centers of sub-reflectors 403, 404 can be varied independently relative to the focal ring. In this way, the phase center of each sub-reflector 403, 404 can be adjusted to coincide respectively with phase centers 401, 402 of the feed horns 301, 302. For example, the phase center defined by sub-reflector 403 can be substantially coincident with the phase center 401 of horn 301. Similarly, the phase center defined by sub-reflector 404 can be substantially coincident with a phase center of horn 302.

In order to permit sub-reflectors 403, 404 to overlap one another as shown, it is desirable that at least one of the sub-reflectors be formed of a frequency selective surface that reflects RF signals having a first frequency and passes RF signals having a second frequency. Frequency selective surfaces are well known in the art. Sub-reflector 404 can be formed of any suitable frequency selective surface that passes signals associated with feed horn 301 but reflects signal associated with feed horn 302. Sub-reflector 403 can be formed of so as to reflect signals associated with feed horn 301 and does not need to be a frequency selective surface.

As illustrated in FIG. 4, the first feed horn 301 can be a corrugated horn and the second feed horn can be a smooth walled or modal horn. However, the invention is not limited in this regard. Further, each of the first and second feed horns can be positioned at a distance from sub-reflectors 403, 404 so as to be decoupled from them.

Figure 5:
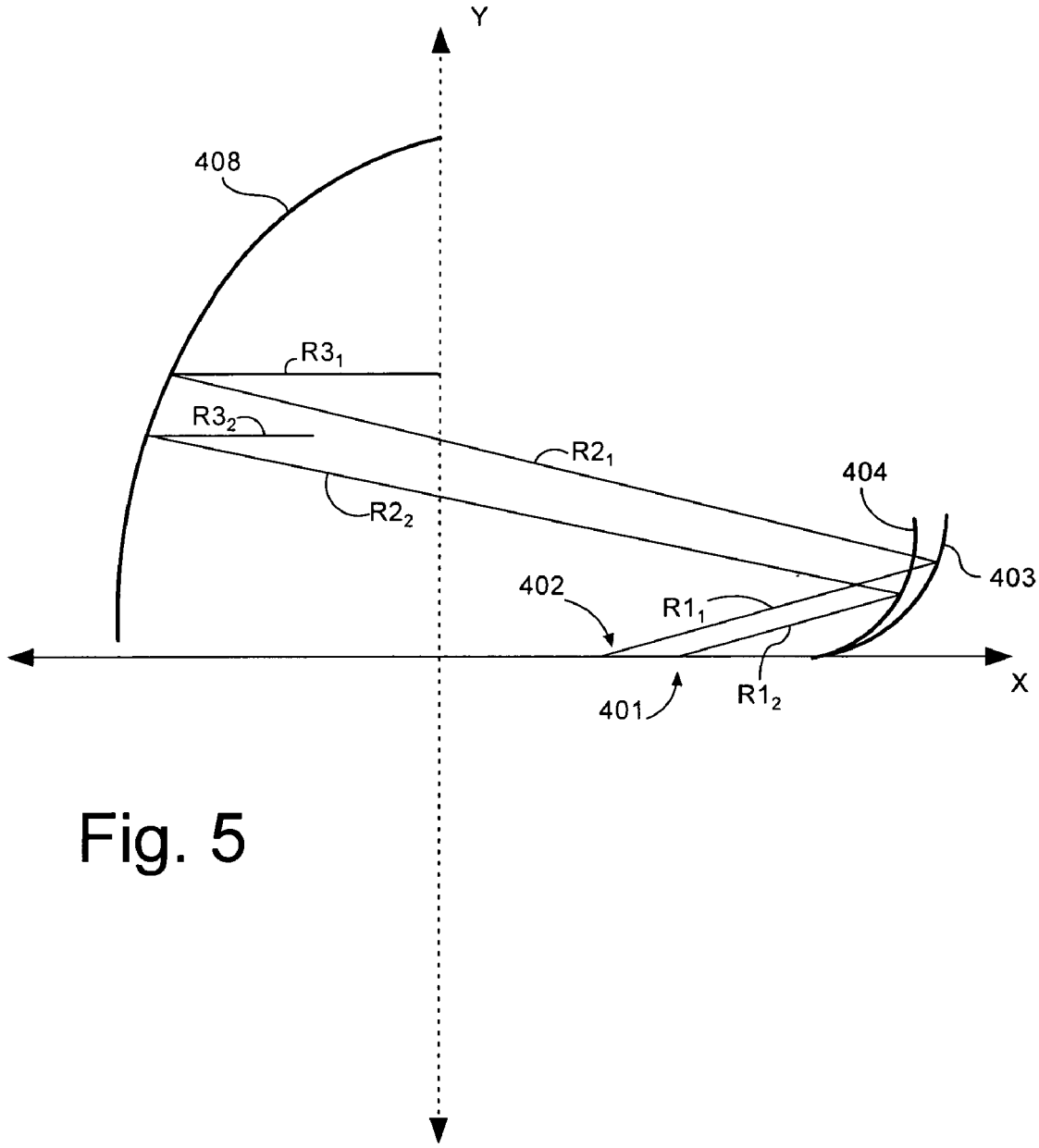
FIG. 5 is a drawing that is useful for understanding concurrent operation of a multi-band coaxial ring focus antenna using co-located sub-reflectors.

Referring now to FIG. 5, a ray diagram is provided that is useful for understanding the operation of the antenna in FIG. 4. Signals originating at feed phase center 402 pass through sub-reflector 404 and reflect off sub-reflector 504 to define a focal ring for main reflector 408. Similarly, signals originating at feed phase center 401 reflect off sub-reflector 404 to define a focal ring for main reflector 408. The arrangement illustrated allows the feed horn phase centers 401, 402 to be physically offset from one another while still accommodating operation of the main reflector 408 on a plurality of spectrally offset frequency bands.

We claim:

1. A method for multi-band operation of a ring focus antenna, comprising:

feeding a main reflector of said ring focus antenna on a first RF frequency band using a first feed horn spaced apart from a first sub-reflector along a boresight axis of said main reflector;

feeding said main reflector on a second RF frequency band spectrally offset from said first band using a second feed horn spaced apart from a second sub-reflector along said boresight axis;

co-locating a vertex of said first and second sub-reflector at a substantially equal distance from said main reflector to form with said first and second sub-reflectors a focal ring for each of said first and second bands at a common predetermined location spaced from said main reflector for concurrently illuminating said main reflector on said first and second bands; and positioning said first and second feed horns so that the phase center of each feed horn is located at a respectively different distance from said co-located vertexes.

2. The method according to claim 1, further comprising the step of positioning at least a portion of said second feed horn coaxially within said first feed horn.

3. The method according to claim 1 further comprising the step of forming said first and second sub-reflectors so that each defines a shaped surface of revolution about said boresight axis of said main reflector having no continuous surface portion thereof shaped as a regular conical surface of revolution.

4. The method according to claim 3 further comprising the step of selecting said main reflector to define a shaped surface of revolution about said boresight axis having no continuous surface portion thereof shaped as a regular conical surface of revolution.

5. The method according to claim 1 further comprising the step of forming at least one of said first and second sub-reflectors as a frequency selective surface.

6. The method according to claim 1 further comprising the step of shaping said first sub-reflector to produce a phase center corresponding to a position of said phase center of said first horn and said second sub-reflector to produce a phase center corresponding to a position of said second horn.

7. The method according to claim 1 further comprising the step of forming said second sub-reflector as a frequency selective surface.

8. The method according to claim 1 further comprising the step of positioning each of said first feed horn and said second feed horn respectively at a distance from said first and second sub-reflectors so that they are decoupled.

9. A multi-band ring focus antenna system, comprising:

a main reflector operable at a plurality spectrally offset frequency bands;

a first feed for said main reflector for operation on a first RF frequency band, said first feed comprising a first feed horn spaced apart from a first sub-reflector along a boresight axis of said main reflector so that they share a commonly located first phase center;

a second feed for said main reflector for operation on a second RF frequency band spectrally offset from said first band, said second feed comprising a second feed horn spaced apart from a second sub-reflector along said boresight axis of said main reflector so that they share a commonly located second phase center; and wherein a first and second vertexes of said respective first and second sub-reflectors are substantially co-located at an equal distance from said main reflector.

10. The multi-band ring-focus antenna system according to claim 9, wherein said first and second sub-reflectors each form a focal ring respectively for each of said first and second bands at a predetermined common location spaced from said main reflector.

11. The multi-band ring-focus antenna system according to claim 9 wherein at least a portion of said second feed horn is coaxially positioned within said first feed horn.

12. The multi-band ring-focus antenna system according to claim 9, wherein said first and second sub-reflectors each defines a shaped surface of revolution about said boresight axis of said main reflector having no continuous surface portion thereof shaped as a regular conical surface of revolution.

13. The multi-band ring-focus antenna system according to claim 9 wherein said main reflector defines a shaped surface of revolution about said boresight axis having no continuous surface portion thereof shaped as a regular conical surface of revolution.

14. The multi-band ring-focus antenna system according to claim 9 wherein at least one of said first and second sub-reflectors is a frequency selective surface.

15. The multi-band ring-focus antenna system according to claim 9 wherein said second sub-reflector is a frequency selective surface.

16. The multi-band ring-focus antenna system according to claim 9 wherein at least a portion of the shaped surface of revolution that comprises said second sub-reflector is interposed between said first horn and said first sub-reflector.

17. The multi-band ring-focus antenna system according to claim 16 wherein said second sub-reflector is a frequency selective surface.

18. The multi-band ring-focus antenna system according to claim 9 wherein said first feed horn is a corrugated horn.

19. The multi-band ring-focus antenna system according to claim 9 wherein said second feed horn is a modal horn.

20. The multi-band ring-focus antenna system according to claim 9 wherein each of said first and second feed horns is decoupled from said first and second sub-reflectors.

* * * * *